United States Patent [19]

Lewallyn

[11] 4,130,048

[45] Dec. 19, 1978

[54] CARPET SAMPLE BEVELING APPARATUS AND METHOD

[76] Inventor: Michael A. Lewallyn, 114 Tibbs Rd., Dalton, Ga. 30720

[21] Appl. No.: 828,665

[22] Filed: Aug. 29, 1977

[51] Int. Cl.[2] ..... B23C 3/12; B24B 9/02

[52] U.S. Cl. ..... 90/18; 51/76 R; 90/21 A; 144/242 G; 198/407; 198/410

[58] Field of Search ..... 90/18, 21 R, 21 A, 11 R; 51/76 R, 74 R; 198/407, 410, 406, 408, 344; 83/435.2; 144/242 G

[56] References Cited

U.S. PATENT DOCUMENTS

| | | | |
|---|---|---|---|
| 1,154,814 | 9/1915 | Smith | 144/242 G |
| 1,850,432 | 3/1932 | Weber | 51/76 R |
| 1,958,525 | 5/1934 | Weber | 51/74 |
| 1,958,526 | 5/1934 | Weber | 51/76 R |
| 2,038,150 | 4/1936 | Weber | 51/76 R |
| 2,170,687 | 8/1939 | Johnson | 51/76 R X |
| 3,146,887 | 9/1964 | Mottin et al. | 198/406 X |
| 3,403,770 | 10/1968 | Boyce et al. | 198/410 X |

*Primary Examiner*—Horace M. Culver

*Attorney, Agent, or Firm*—B. P. Fishburne, Jr.

[57] ABSTRACT

Pre-cut square carpet samples are placed edgewise on the first of a stepped series of pairs of sample conveyor belts, the belts of each pair being separated to accommodate between them a power-operated beveler. An inclined sheet metal backing plate is provided adjacent each pair of the conveyor belts and has a cut-out through which another series of stepped belts operates immediately above each pair of conveyor belts in a plane at right angles thereto, the second series of belts spanning the spaces between the conveyor belts of each pair. Spring pressure bars lie immediately forwardly of and parallel to the belts of the second series and resiliently press the carpet samples into contact with the belts of the second series to assure firm contact of each edge of every carpet sample with the powered beveler as each sample passes thereover. At the downstream end of each pair of conveyor belts, each sample tumbles onto the next lowermost pair and in so doing rotates 90 degrees with the assistance of a provided air jet to present another edge of each sample to the next powered beveler.

10 Claims, 7 Drawing Figures

CARPET SAMPLE BEVELING APPARATUS AND METHOD

BACKGROUND OF THE INVENTION

Customarily, square carpet samples measuring one inch by 1 inch up to 6 inches by 6 inches have been beveled by hand by presenting their edges to a power-operated beveling machines of a well-known type. While such hand operation produces a satisfactory product, the procedure is time consuming and costly and does not satisfactorily meet the needs of an expanding industry.

Attempts have been made to construct automatic carpet sample beveling machines, but thus far these have not proven satisfactory or practical, and have been complicated and costly with many complex adjustments to accommodate samples of different sizes.

With the above in mind, the present invention has as its objective to satisfy the deficiencies of the prior art by providing a carpet sample beveling apparatus of much greater efficiency and simplicity which is at least 4 times faster than any known prior art means. Approximately one sample per second can be beveled by a single operator utilizing the apparatus of the invention.

Known prior art United States patents having some broad relevance to the invention are U.S. Pat. Nos. 3,446,103 and 3,654,735.

SUMMARY OF THE INVENTION

Essentially the invention consists of a stepped series of pairs of conveyor belts whose upper runs travel horizontally in a longitudinal direction but are sloped transversely to assure that the carpet samples will not fall from the belts during processing. The belts of each stepped pair are spaced apart longitudinally to provide for the placement of a conventional power driven beveling device such as a table model bevel edge trimming machine manufactured by B and J Machinery Company, Inc., York Street, Dalton GA. Other equivalent beveling devices may be employed.

At the inner sides of each stepped pair of conveyor belts, generally vertical somewhat inclined fixed back plates rise above the conveyor belts to provide a support for the carpet samples moving on edge on the conveyor belts and stabilizing them. Each back plate has a notch or cut-out spanning the space between the conveyor belts of each pair and the cut-outs accommodate a second series of endless driving belts immediately above and at one side of the first-named series and operating in a plane at right angles thereto. The belts in the second series also span the space or gap between the conveyor belts of each pair in the first-named stepped series. The active faces of the belts in the second series operate through the cut-outs of the back plates. Spring pressure arms lie forwardly of the active faces of the belts of the second series and are substantially coextensive therewith. These pressure arms assure that each carpet sample is firmly pressed into contact with the driving belts of the second series during the critical times when the samples are being acted on by the power bevelers in the gaps between the belts of the first-named series.

After having one edge beveled during passage over each pair of conveyor belts in the first stepped series, the samples tumble downwardly onto the next lowermost pair of belts, and in so doing rotate 90 degrees with the assistance of air jet means which are provided between the stepped pairs of belts in the first series. In so doing, another edge of each carpet sample is positioned in the proper manner to be acted on by the power beveler arranged between the pair of belts in the next lowermost position in the stepped series of belts. When the four edges of each sample have been beveled automatically in this manner, the carpet samples tumble in succession from the lowermost pair of conveyor belts into a suitable collection container.

DETAILED DESCRIPTION

Figure 1:
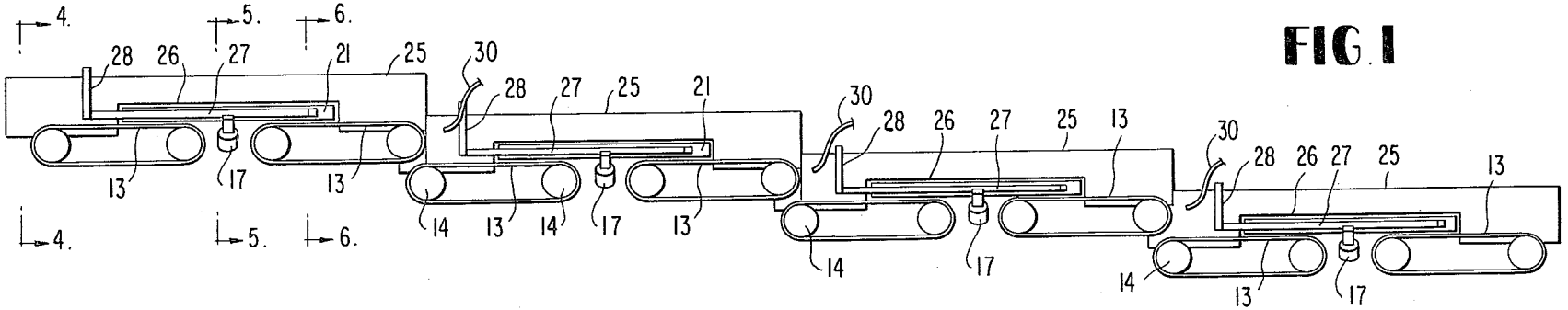
FIG. 1 is a partly schematic side elevation of an apparatus for automatically beveling carpet samples embodying the invention.

Referring to the drawings in detail, wherein like numerals designate like parts, the numeral 10 designates a sturdy supporting angle bar for the various components of the apparatus. The angle bar 10 is disposed horizontally in the longitudinal direction but is tilted laterally at an angle as depicted in FIGS. 4 to 7. The supporting angle bar 10 and all of the components mounted thereon are held at a convenient elevation by a base frame 11, FIG. 7, having upper support arms 12 which are securely attached to the supporting angle bar 10, as illustrated.

Figure 2:
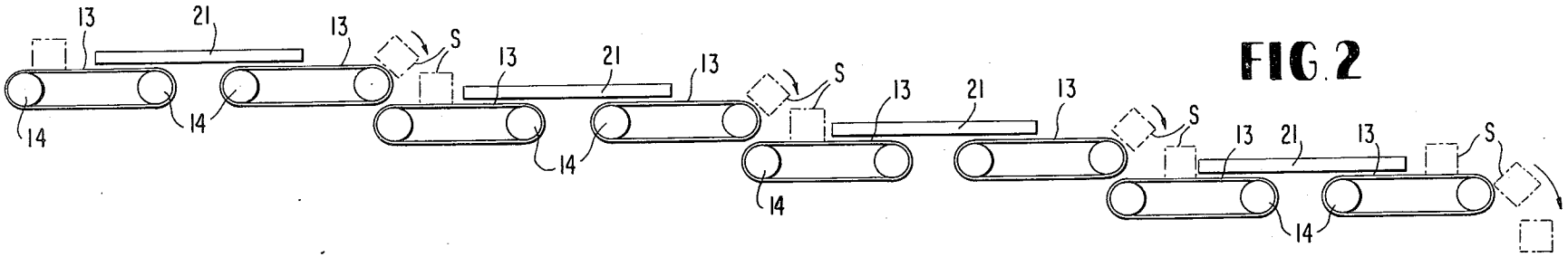
FIG. 2 is a partly schematic side elevation of the apparatus with parts omitted, illustrating the tumbling operation of carpet samples as they pass through the apparatus from one stepped level to the next.
Figure 3:
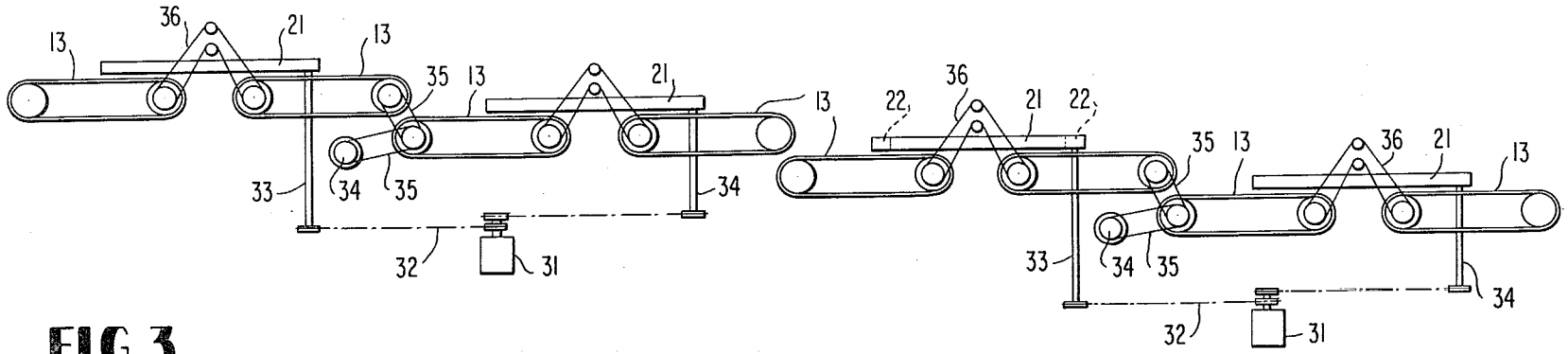
FIG. 3 is another side elevational view of the apparatus showing the power drive trains for the belts which are omitted for clarity in FIGS. 1 and 2.
Figure 4:
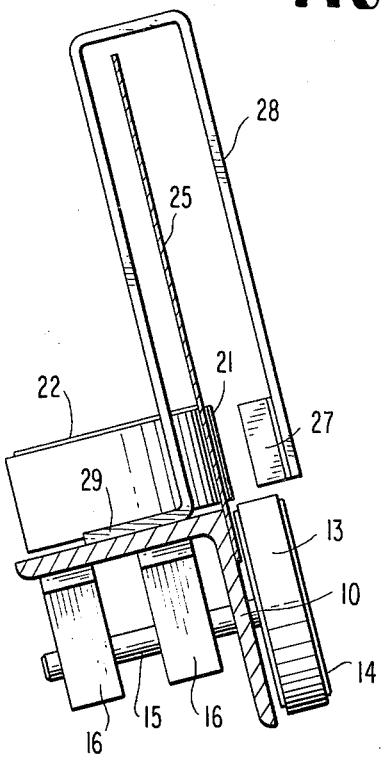
FIG. 4 is an enlarged transverse vertical section taken through the apparatus on line 4—4 of FIG. 1.

As will be understood in connection with FIGS. 1 to 3, the supporting angle bar 10 is formed in four stepped segments and the support frame 11 is also formed in a corresponding number of sections of decreasing heights so as to support the several sections of the bar 10 at the necessary elevations in the apparatus.

Figure 6:
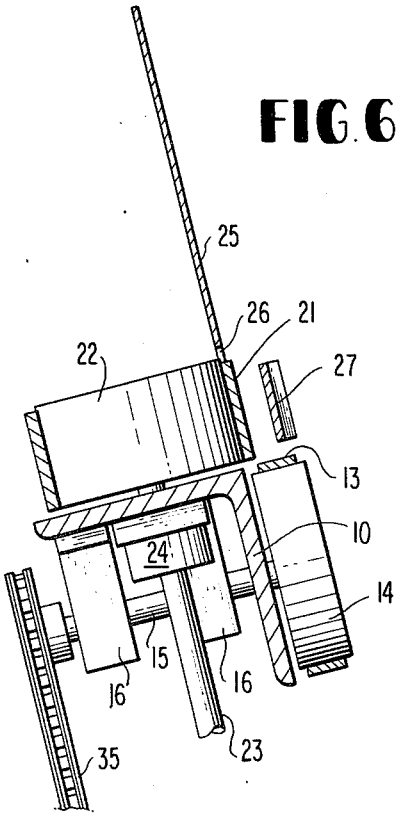
FIG. 6 is a similar section taken on line 6—6 of FIG. 1.
Figure 7:
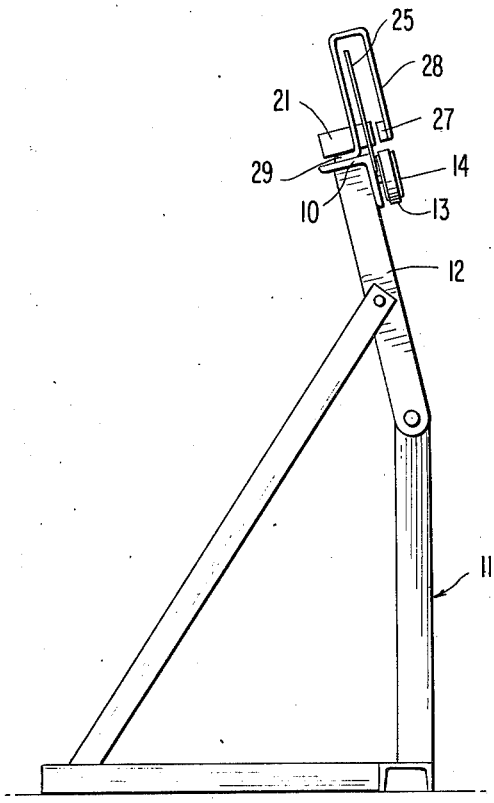
FIG. 7 is an end elevational view of the apparatus.

Adjacent to each section of the support bar 10, a pair of spaced equal length endless conveyor belts 13 are arranged close to the generally vertical web of the bar 10, FIG. 6, with their upper runs extending horizontally in the longitudinal direction while being tilted laterally to the same degree that the bar 10 is tilted. In this manner, the conveyor belts 13 are arranged in the apparatus in four descending stepped pairs, with the belts 13 of each pair spaced apart endwise equidistantly.

Figure 5:
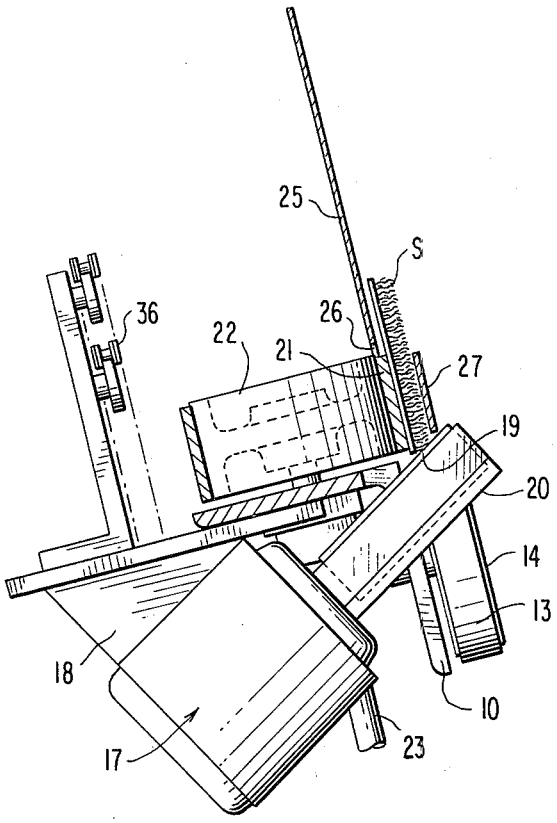
FIG. 5 is a similar section taken on line 5—5 of FIG. 1.

The supporting and driving pulleys 14 for the belts 13 are carried by inclined shafts 15 held in bearing 16, dependingly secured to the top web of each section 10 of the supporting angle bar. In the space or gap between each pair of belts 13 in the stepped array of belts is a conventional power driven beveler device 17, such as a table model bevel edge trimming machine, manufactured and sold by B and J Machinery Company, Inc., York Street, Dalton, GA. Each beveling device 17 is fixedly supported on one of the bar sections 10 by a suitable support bracket 18, FIG. 5, depending therefrom. Each beveling device 17 includes a rotary cutter 19 and cutter guard 20, whose axes are inclined with respect to the carpet sample S, FIG. 5, whereby each edge of the sample can be properly beveled while passing over the cutter 19. The adjacent supporting bar section 10 is notched or cut out as shown in FIG. 5 to accommodate the cutter 19 and guard 20.

Immediately above each pair of the belts 13 in the stepped array is a coacting sample drive belt 21 whose active run or face is disposed adjacent to the inner longitudinal edges of the pair of belts 13 with which it is associated. The active faces of the belts 21 operate in planes at right angles to the top runs of the belts 13. The active faces of the belts 21 are inclined to the vertical at the same inclination as the bar sections 10 on which they are supported. The belts 21 span the gaps or spaces between the belts 13 in the stepped array to provide traction for the carpet samples S in the critical areas where they are being acted on by the beveling devices 17.

The driving belts 21 in this manner form a second downwardly stepped array of belts which are operating in planes at right angles to the belts 13 immediately above the top runs of the latter. By means to be described hereinafter, all of the belts 13 and 21 are driven forwardly in unison at the same linear speeds.

Pulleys 22 for the belts 21 are carried in generally vertical inclined axis shafts 23 journaled in bearings 24 mounted on the bottoms of the upper webs of supporting angle bar sections 10, as best shown in FIG. 6. Adjacent to each belt 21 and coacting pair of belts 13 is a generally vertical somewhat inclined stationary back plate 25 which rises above the angle bar section 10 to which it is attached by any convenient means. Each back plate 25 has a longitudinal notch or cut out 26, through which the active face or run of the adjacent belt 21 projects, FIG. 6, so as to be capable of engaging and frictionally driving the back of each carpet sample S passing through the apparatus. The purpose of the back plates 25 is to support and stabilize the carpet samples S while they travel edgewise on the belts 13 through the apparatus. Being at a slight inclination to the vertical, the samples S slide along the back plates 25 during transportation through the apparatus without a tendency to tumble forwardly and fall off the belts 13. This inclination is a significant feature lending to the successful operation of the apparatus.

Cooperating with each belt 21 is a spring pressure arm or bar 27 which is substantially coextensive lengthwise with the belt 27 and substantially parallel thereto and spaced slightly forwardly from the active face of the belt 21. Each spring pressure bar 27 has an end U-shaped mounting yoke 28 carrying a foot flange 29 which is attached to the top web of the adjacent supporting bar section 10. As shown in the drawings, the yokes 28 are looped over the top edges of the back plates 25 and descend forwardly of the back plates to support the spring pressure arms 27 in opposing relationship to the belts 21.

As the carpet samples S move in succession through the apparatus, at each beveling station adjacent to one of the bevelers 17, the samples must pass between the pressure arms 27 and the cooperating belts 21, and the spring force of the arms 27 presses the samples firmly against the drive belts 21 to assure that they are properly held and positively driven forwardly.

As will be noted particularly in FIG. 2, when each carpet sample S reaches the end of the second conveyor belt 13 in each step pair, it tumbles by gravity edgewise onto the next lowermost belt 13 and in so doing rotates 90 degrees to present a new lower edge to the beveling device 17 at the new level. Air jets from conduits 30, FIG. 1, between each level of the apparatus act on the carpet samples S and assist in the rotation thereof while they are tumbling to the next level. The inclination of the apparatus to the vertical, FIGS. 4 to 6, allows the samples to rest against the back plate 25 at all times, so that there is no tendency for the samples to lose their stability or fall forwardly.

At each stepped level of the apparatus, the samples S pass in succession between the belts 21 and pressure bars 27 and are thereby held firmly in the previously-described manner while their several lower edges are being presented to the beveling devices 17 for clean and smooth beveling at the approximate angle illustrated in FIG. 5 of the drawings.

The above operation or method is simple and direct. It takes advantage of gravity in a unique way and the necessity for complex adjustment of the apparatus to handle various sizes of carpet samples is entirely eliminated. This is one of the prime improvement features of the invention over the prior art.

The driving system for the apparatus is shown schematically in FIG. 3, and comprises a pair of vertical axis gear head motors 31 which are conventionally synchronized. Horizontal gearing 32 powered by the gear head motors 31 is operatively connected with the generally vertical drive shafts 23 which are in turn connected with and drive the downstream pulleys 22 of belts 21 in two pairs, as shown in FIG. 3.

An additional pair of gear head motors 34 having axes at right angles to the motors 31 operates the stepped pairs of belts 13 in unison and at the same speed as the belts 21 through suitable gearing 35. The belts 13 of the pairs at different levels in the apparatus are drivingly connected by additional conventional gearing 36 which is arched in the manner shown to provide clearance for the beveling devices 17 immediately under the belts 21, FIG. 5, and between the spaced belts 13 of each stepped pair. These devices 17 are not shown in FIG. 3.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A method of beveling rectangular carpet samples along all of their four marginal edges comprising conveying rectangular carpet samples in succession along a horizontal path having vertical steps in said path at descending elevations while the carpet samples are supported on their edges at an inclination to the vertical for the sake of stability of the samples, engaging each sample in succession at each stepped elevation along the horizontal path and exerting a yielding holding force on the sample and beveling the lower edge of each sample during application of said holding force, and causing each carpet sample in succession to free-fall by gravity from each stepped elevation along said horizontal path to the next lowermost stepped elevation and during such free-falling to rotate ninety degrees edgewise thereby positioning another lower edge of each sample for beveling at each successive stepped elevation until the four edges of each sample are beveled.

2. The method of claim 1, and the additional step of directing a gas jet on each free-falling carpet sample between each stepped elevation to assist in rotating each sample 90°.

3. The method of claim 1, and the additional step of drivingly engaging each carpet sample on its side away from said holding force to frictionally drive the sample forwardly while each lower edge thereof is being beveled.

4. An apparatus for beveling rectangular carpet samples automatically and continuously comprising a stepped array of conveyor belts including a pair of spaced belts at each level of the array, plural coacting drive belts near and above the conveyor belts in each pair of said stepped array and operating substantially at right angles to the belts in the stepped array and disposed adjacent corresponding longitudinal edges of the belts of the stepped array, power means to drive all of the belts in unison and at the same speed, powered beveling devices arranged between the conveyor belts of each pair and near and below said drive belts and being disposed at an angle to the drive belts, the drive belts spanning the spaces between the pairs of conveyor belts in the stepped array, a relatively stationary inclined back plate extending adjacent to each pair of said conveyor belts at each step in the array and having a cut-out through which one of said drive belts operates immediately above one pair of conveyor belts, and a yielding pressure bar spaced forwardly of each drive belt and above the adjacent pair of conveyor belts and exerting a yielding pressure on each carpet sample passing through the apparatus while the lower edges of each sample are being beveled by the beveling devices at the several steps of said apparatus.

5. An apparatus as defined in claim 4, and said conveyor and drive belts and said back plates being somewhat inclined to the vertical so that carpet samples disposed on edge are prevented from tipping forwardly and falling off of the apparatus while passing therethrough.

6. An apparatus as defined in claim 4, and said conveyor belts and coacting drive belts operatively mounted in right angular planes on stepped supporting bar sections.

7. An apparatus as defined in claim 6, and said powered beveling devices secured fixedly to said supporting bar sections, each supporting bar section being notched to receive a rotary cutter of one beveling device.

8. An apparatus as defined in claim 7, and each pressure bar secured to one of said supporting bar sections.

9. An apparatus as defined in claim 4, and said power means including gear head motors and gearing drivingly connected with pulleys of said conveyor belts and said drive belts.

10. An apparatus as defined in claim 6, and support frame means holding said stepped supporting bar sections at predetermined convenient locations.

* * * * *